US009296965B2

(12) United States Patent
Bi et al.

(10) Patent No.: US 9,296,965 B2
(45) Date of Patent: Mar. 29, 2016

(54) SYSTEM AND METHOD FOR PREPARING COAL WATER SLURRY

(71) Applicant: General Electric Company, Schenectady, NY (US)

(72) Inventors: Xijing Bi, Shanghai (CN); Junli Xue, Shanghai (CN); Dejia Wang, Shanghai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 179 days.

(21) Appl. No.: 14/089,825

(22) Filed: Nov. 26, 2013

(65) Prior Publication Data

US 2014/0150331 A1 Jun. 5, 2014

(30) Foreign Application Priority Data

Nov. 30, 2012 (CN) ..... 2012 1 0506847

(51) Int. Cl.
*C10L 1/32* (2006.01)

(52) U.S. Cl.
CPC ..... *C10L 1/326* (2013.01)

(58) Field of Classification Search
CPC ..... C10L 1/326
See application file for complete search history.

(56) References Cited

U.S. PATENT DOCUMENTS 3,168,350 A * 2/1965 Phinney et al. ..... 406/197
3,762,887 A * 10/1973 Clancey et al. ..... 44/280
4,282,006 A 8/1981 Funk
4,500,041 A 2/1985 Nakaoji et al.
4,706,891 A 11/1987 Nakaoji et al.
4,887,383 A * 12/1989 Mathiesen et al. ..... 44/280
5,599,356 A 2/1997 Hashimoto et al.
6,053,954 A 4/2000 Anderson et al.
6,132,478 A 10/2000 Tsurui et al.

FOREIGN PATENT DOCUMENTS

CN 85106713 A 11/1986
CN 101995029 A 3/2011
CN 102192520 A 9/2011
CN 102443450 A 5/2012

OTHER PUBLICATIONS

Usuia et al., "Rheology of Low Rank Coal Slurries Prepared by an Upgrading Process", Coal Preparation, vol. 18, Issue 3-4, pp. 119-128, 1997.

Harmadi et al., "Effect of Particle Size Distribution on Rheology and Stability of High Concentration Coal-Water Mixture (Cwm) with Indonesian Low Rank Coal", Jurnal Teknik Mesin, vol. 2, Issue 3, Sep. 2002.

(Continued)

*Primary Examiner* — Cephia D Toomer
(74) *Attorney, Agent, or Firm* — GE Global Patent Operation; Peter T. DiMauro

(57) ABSTRACT

A system for preparing a coal water slurry, comprising: a first unit for providing a stream of coarse coal water slurry; a second unit for providing a stream of ultrafine coal water slurry; a third unit for providing a stream of dry coarse coal particles; and a mixing unit for mixing the stream of coarse coal water slurry, the stream of ultrafine coal water slurry and the stream of dry coarse coal particles. An associated method is also presented.

20 Claims, 4 Drawing Sheets

(56) References Cited

OTHER PUBLICATIONS

"Optimal Particle Size Distribution of Coal for Preparation of Increased Concentration Coal Water Slurry in Gasification", IPCOM000206287D, pp. 1-7, Apr. 18, 2011.

Li, "Progress of High Concentration Coal Water Slurry (CWS) Preparation Technology from Low Rank Coals and Lignite for CWS Gasification", Chinese Academy of Sciences Sep. 12-15, 2011.

Unofficial English Translation of Chinese Office Action issued in connection with corresponding CN Application No. 201210506847.8 on Feb. 10, 2015.

* cited by examiner

SYSTEM AND METHOD FOR PREPARING COAL WATER SLURRY

BACKGROUND OF THE INVENTION

Embodiments of the present invention relate generally to systems and methods for preparing coal water slurries.

Coal water slurries are widely used these days in such as gasification industries. Generally, higher coal concentration in a coal water slurry with an acceptable viscosity are more desirable. However, currently available systems and methods cannot provide satisfactory coal water slurries, especially from low rank coals.

Therefore, there is a need for new and improved systems and methods for preparing coal water slurries.

BRIEF DESCRIPTION OF THE INVENTION

In one aspect, a system for preparing a coal water slurry is provided and comprises a first unit for providing a stream of coarse coal water slurry; a second unit for providing a stream of ultrafine coal water slurry; a third unit for providing a stream of dry coarse coal particles; and a mixing unit for mixing the stream of coarse coal water slurry, the stream of ultrafine coal water slurry and the stream of dry coarse coal particles.

In another aspect, a method for preparing a coal water slurry is provided and comprises: preparing a stream of coarse coal water slurry; preparing a stream of ultrafine coal water slurry; preparing a stream of dry coarse coal particles; and mixing the stream of coarse coal water slurry, the stream of ultrafine coal water slurry and the stream of dry coarse coal particles.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF THE INVENTION

Figure 1:
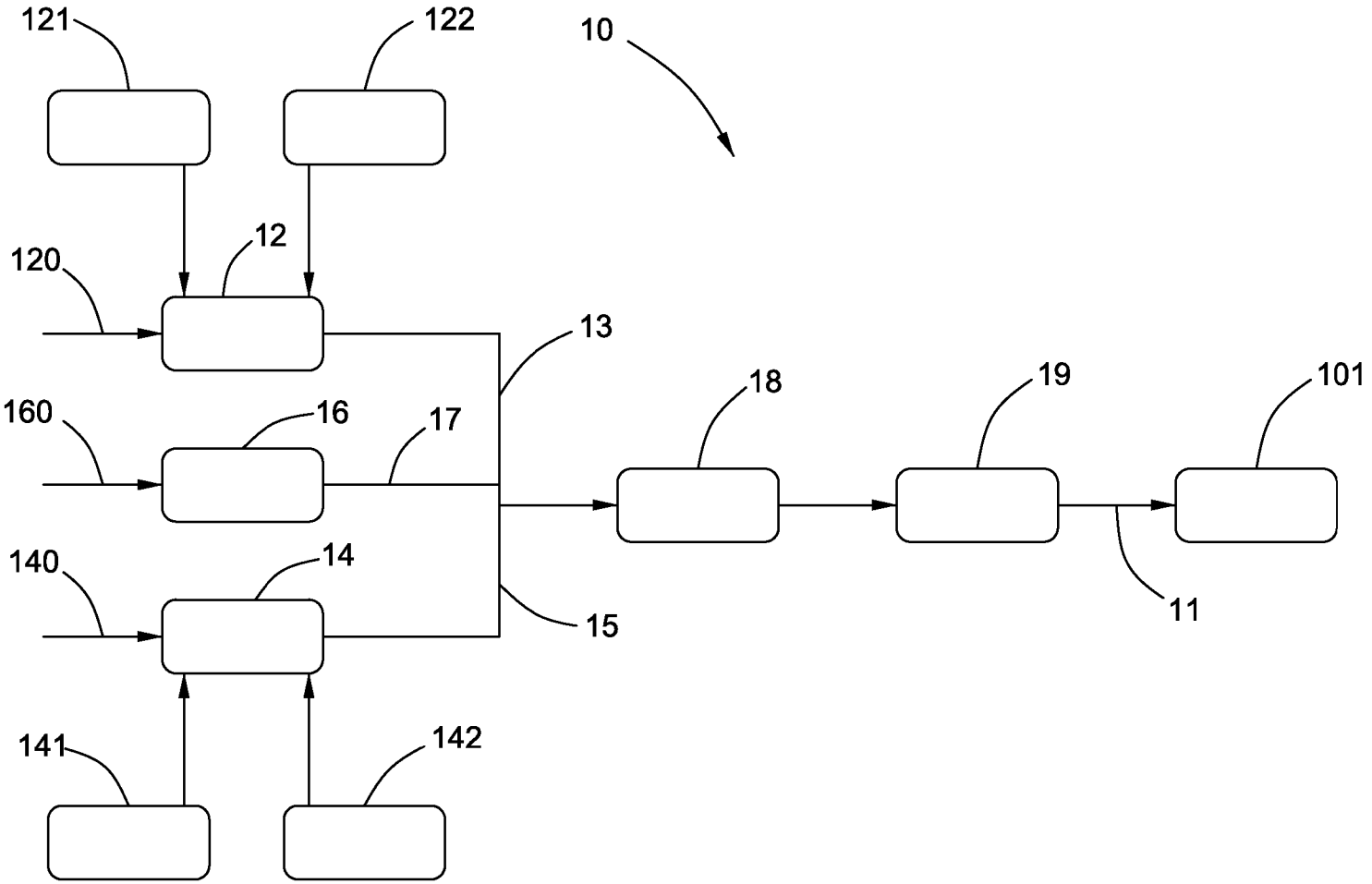
FIG. 1 is a schematic diagram of a system for preparing a coal water slurry in accordance with a first embodiment of the present invention.

Approximating language, as used herein throughout the specification and claims, may be applied to modify any quantitative representation that could permissibly vary, without resulting in a change in the basic function to which it is related. Accordingly, a value modified by a term or terms, such as "about", is not limited to the precise value specified. In some instances, the approximating language may correspond to the precision of an instrument for measuring the value.

In the following specification and claims, the singular forms "a", "an" and "the" include plural referents, unless the context clearly dictates otherwise. Moreover, the suffix "(s)" as used herein is usually intended to include both the singular and the plural of the term that it modifies, thereby including one or more of that term. The terms "first," "second," and the like, herein do not denote any order, quantity, or importance, but rather are used to distinguish one element from another or one embodiment from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable. For example, in some circumstances, an event or capacity can be expected, while in other circumstances, the event or capacity cannot occur. This distinction is captured by the terms "may" and "may be".

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 600 to 1000, it is intended that values such as 600 to 850, 651 to 902, 700 to 851, 800 to 1000 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Reference throughout the specification to "one embodiment," "another embodiment," "an embodiment," "some embodiments," and so forth, means that a particular element (e.g., feature, structure, and/or characteristic) described in connection with the invention is included in at least one embodiment described herein, and may or may not be present in other embodiments. In addition, it is to be understood that the described inventive features may be combined in any suitable manner in the various embodiments and configurations.

Embodiments of the present disclosure will be described hereinbelow with reference to the accompanying drawings. In the following description, well-known functions or constructions are not described in detail to avoid obscuring the disclosure in unnecessary detail.

Figure 2:
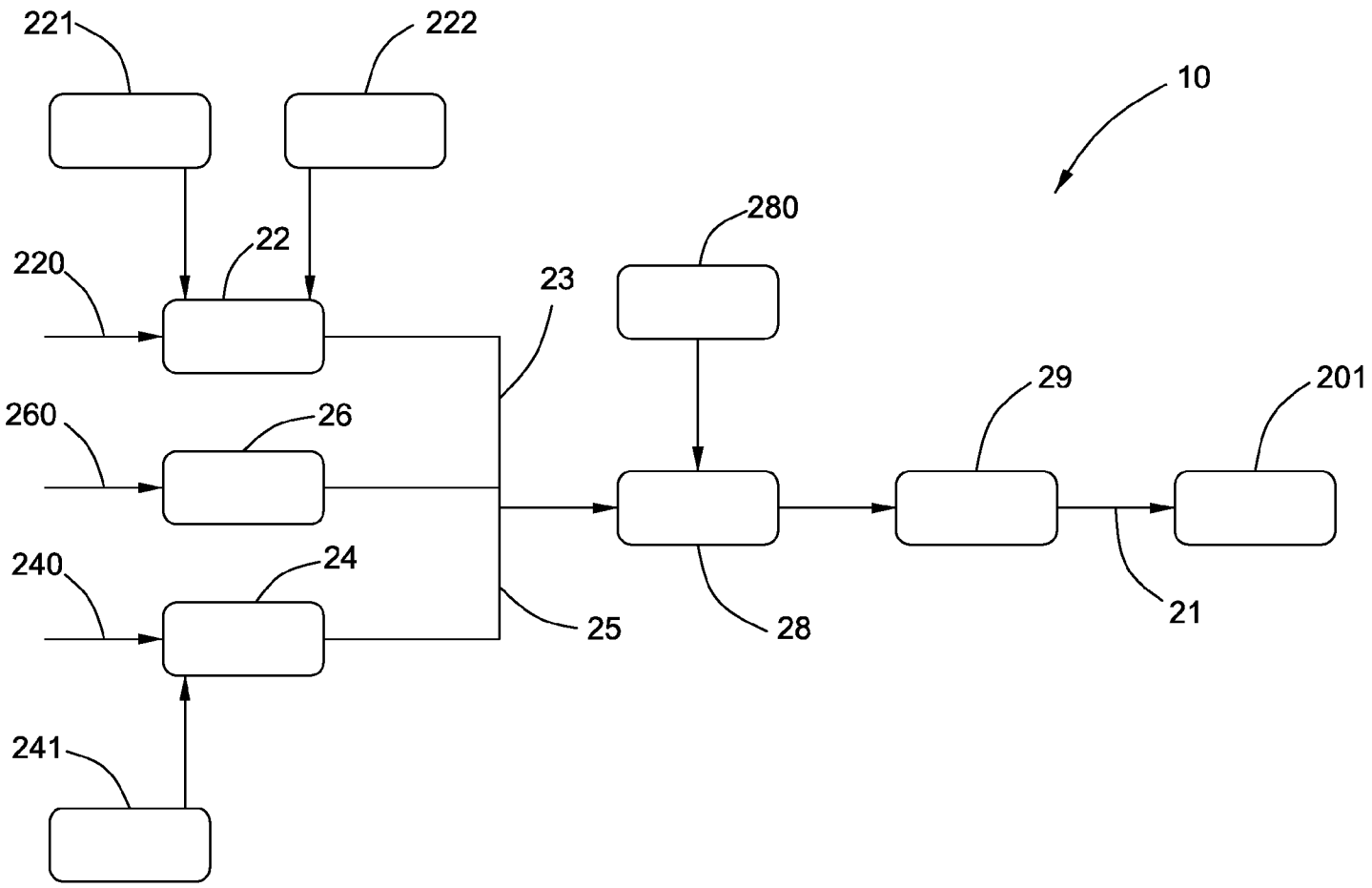
FIG. 2 is a schematic diagram of a system for preparing a coal water slurry in accordance with a second embodiment of the present invention.
Figure 3:
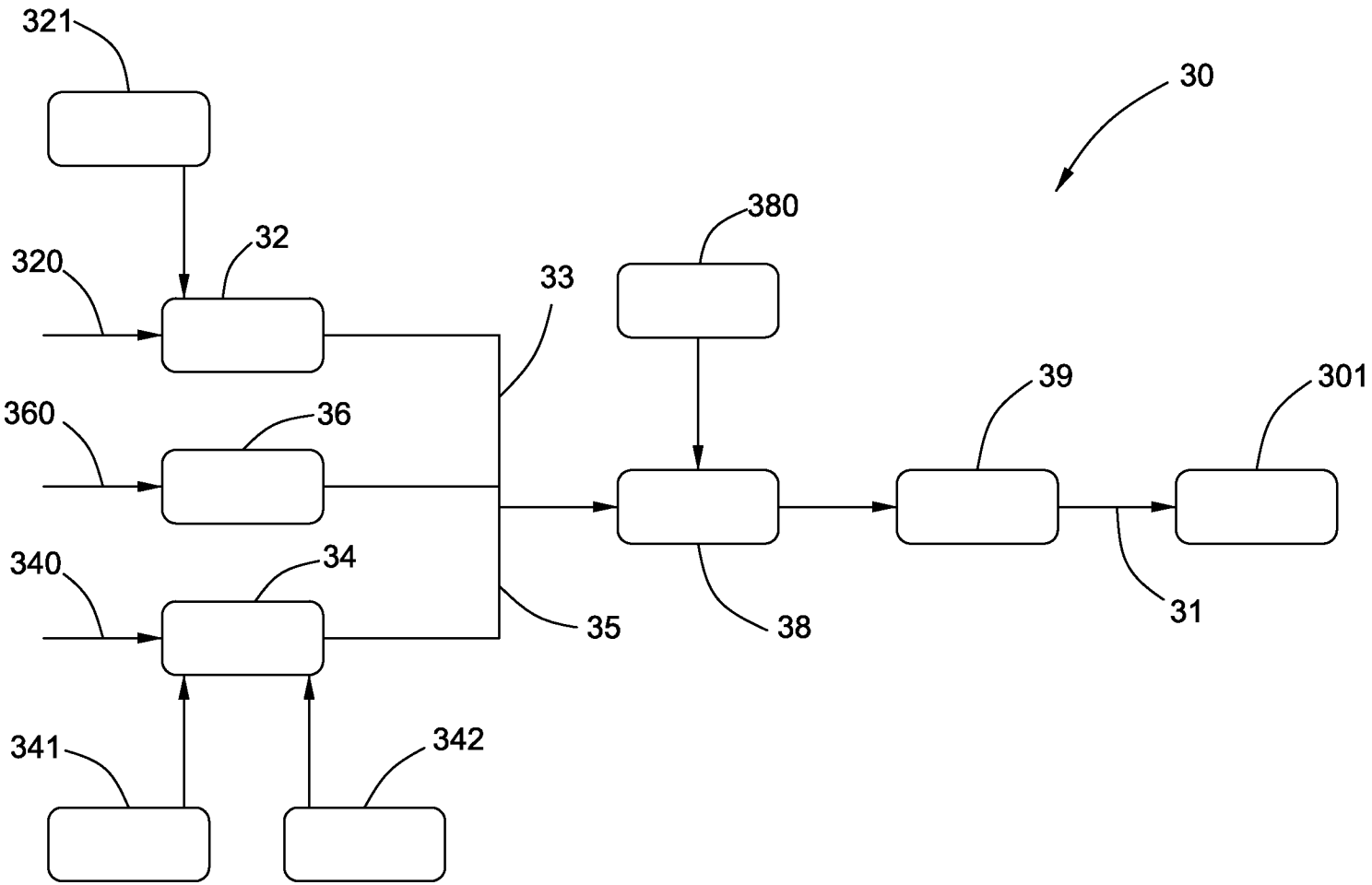
FIG. 3 is a schematic diagram of a system for preparing a coal water slurry in accordance with a third embodiment of the present invention.
Figure 4:
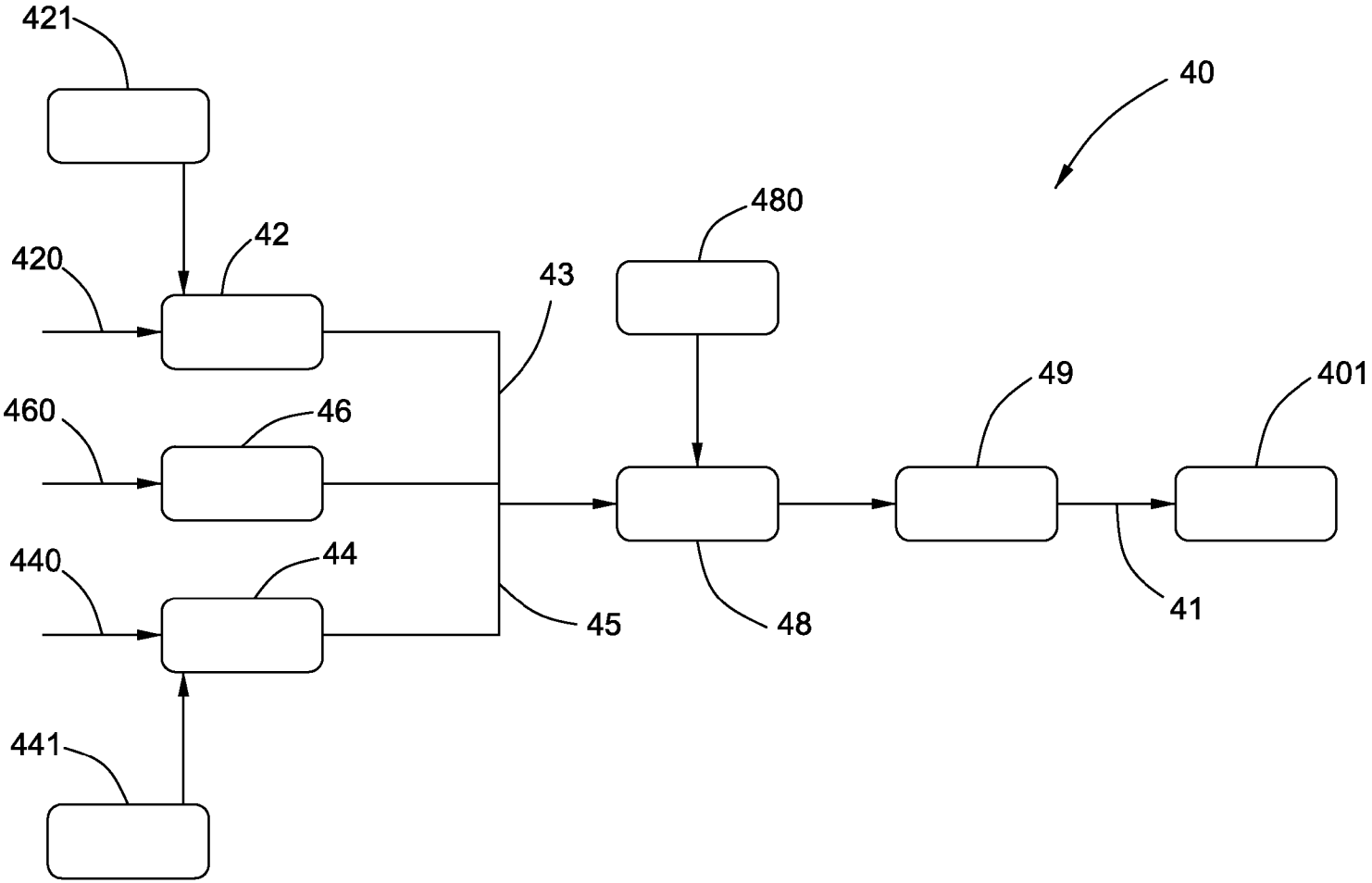
FIG. 4 is a schematic diagram of a system for preparing a coal water slurry in accordance with a fourth embodiment of the present invention.

FIGS. 1-4 illustrate schematic diagrams of system 10-40 for preparing coal water slurries 11-41 in accordance with embodiments of the invention. The system 10, 20, 30, 40 comprises a first unit 12, 22, 32, 42 for providing a stream of coarse coal water slurry 13, 23, 33, 43; a second unit 14, 24, 34, 44 for providing a stream of ultrafine coal water slurry 15, 25, 35, 45; a third unit 16, 26, 36, 46 for providing a stream of dry coarse coal particles 17, 27, 37, 47; and a mixing unit 18, 28, 38, 48 for mixing the stream of coarse coal water slurry 13, 23, 33, 43, the stream of ultrafine coal water slurry 15, 25, 35, 45 and the stream of dry coarse coal particles 17, 27, 37, 47.

In the first unit 12, 22, 32, 42, coal 120, 220, 320, 420 and water 121, 221, 321, 421 are provided to a wet mill, such as a wet rod mill, to prepare the stream of coarse coal water slurry 13, 23, 33, 43. An additive 122, 222 is added to the first unit 12, 22 for preparing the stream of coarse coal water slurry 13, 23. In some embodiments, the stream of coarse coal water slurry 13 comprises coal particles having a maximum particle size of less than about 1500 μm and a mean particle size of greater than about 100 μm.

In the second unit 14, 24, 34, 44, coal 140, 240, 340, 440 and water 141, 241, 341, 441 are provided to a wet fine mill to prepare the stream of ultrafine coal water slurry 15, 25, 35, 45. An additive 142, 342 is added to the second unit 14, 34 for preparing the stream of ultrafine coal water slurry 15, 33. In non-limiting examples, the second unit 14, 24, 34, 44 may comprise a fine mill including a vibrating mill or a roller grinding mill. In one example, the second unit 14, 24, 34, 44 comprises a Loesehe mill. In some embodiments, the stream of ultrafine coal water slurry 15, 25, 35, 45 comprises coal particles having a mean particle size of smaller than about 20 μm.

In the third unit 16, 26, 36, 46, coal 160, 260, 360, 460 is provided to a dry mill, e.g. a ball mill, or a dry crusher, to prepare the stream of dry coarse coal particles 17, 27, 37, 47. In some embodiments, the stream of dry coarse coal particles 17, 27, 37, 47 comprises coal particles having a maximum particle size of less than about 1500 μm and a mean particle size of greater than about 100 μm.

In some applications, one or more mills or crushers may be employed in each of the first unit 12, 22, 32, 42, the second unit 14, 24, 34, 44, and the third unit 16, 26, 36, 46.

In some applications, the coal 120, 140, 160, 220, 240, 260, 320, 340, 360, 420, 440, 460 may comprise one or more of high rank coal, such as bituminous and anthracite, and low rank coal, such as sub-bituminous coal and lignite. In some examples, the coal 120, 140, 160, 220, 240, 260, 320, 340, 360, 420, 440, 460 may comprise a mixture of the low rank coal particles and the high rank coal particles. In one non-limiting example, the coal 120, 140, 160, 220, 240, 260, 320, 340, 360, 420, 440, 460 comprises low rank coal particles, such as the sub-bituminous coal and the lignite. Since the cost of low rank coal is lower, it may be cost-effective in some examples to produce the coal water slurry having higher coal concentration using the low rank coal. In other examples, the coal 120, 140, 160, 220, 240, 260, 320, 340, 360, 420, 440, 460 comprises high rank coal particles.

The particle sizes of the coal 120, 140, 160, 220, 240, 260, 320, 340, 360, 420, 440, 460 may be smaller than about 3 mm. Alternatively, the particle sizes of the coal 120, 140, 160, 220, 240, 260, 320, 340, 360, 420, 440, 460 may be different from each other and greater than about 3 mm. One or more coal supply sources (not shown) may be employed to provide each of the coal 120, 140, 160, 220, 240, 260, 320, 340, 360, 420, 440, 460.

In certain applications, one or more of the coals 120, 140, 160, 220, 240, 260, 320, 340, 360, 420, 440, and 460 may comprise one or two of the low rank coal and the high rank coal, and the coals 120, 140, 160, 220, 240, 260, 320, 340, 360, 420, 440, and 460 may be the same or different from each other. In one non-limiting example, the coals 120, 140, 160, 220, 240, 260, 320, 340, 360, 420, 440, and 460 comprise the same low rank coal. Alternatively, the coals 120, 140, 160, 220, 240, 260, 320, 340, 360, 420, 440, and 460 comprise the same high rank coal.

The stream of coarse coal water slurry 13, 23, 33, 43, the stream of ultrafine coal water slurry 15, 25, 35, 45 and the stream of dry coarse coal particles 17, 27, 37, 47 are mixed in the mixing unit 18, 28, 38, 48 at appropriate ratios to prepare the coal water slurry 11, 21, 31, 41. In some embodiments, the coal from the stream of coarse coal water slurry 13, 23, 33, 43 is greater than about 30 wt % of coal of the coal water slurry 11, 21, 31, 41. In some embodiments, the coal from the stream of ultrafine coal water slurry 25, 25, 35, 45 is less than about 30 wt % of coal of the coal water slurry 11, 21, 31, 41.

In some examples, prior to introduction into the mixing unit 18, 28, 38, 48, the particle size distribution of stream of coarse coal water slurry 13, 23, 33, 43, the stream of ultrafine coal water slurry 15, 25, 35, 45 and the stream of dry coarse coal particles 17, 27, 37, 47 may be analyzed, for example, by a laser PSD analyzer for facilitation of determination of the amounts of the stream of coarse coal water slurry 13, 23, 33, 43, the stream of ultrafine coal water slurry 15, 25, 35, 45 and the stream of dry coarse coal particles 17, 27, 37, 47 from the first unit 12, 22, 32, 42, the second unit 14, 24, 34, 44, and the third unit 16, 26, 36, 46.

For some arrangements, during mixing, a mixer (not shown) may be employed to mix the stream of coarse coal water slurry 13, 23, 33, 43, the stream of ultrafine coal water slurry 15, 25, 35, 45 and the stream of dry coarse coal particles 17, 27, 37, 47 within the mixing unit 18, 28, 38, 48, and feed rates of the stream of coarse coal water slurry 13, 23, 33, 43, the stream of ultrafine coal water slurry 15, 25, 35, 45 and the stream of dry coarse coal particles 17, 27, 37, 47 may be controlled for introduction into the mixing unit 18, 28, 38, 48 so as to ensure the water in the coarse coal water slurry 13, 23, 33, 43 and the ultrafine coal water slurry 15, 25, 35, 45 to contact with the dry coal particles 17, 27, 37, 47 and the relatively smaller coal particles to be dispersed between the relatively larger coal particles.

As used herein, the term "coal water slurry" may indicate a mixture of certain amounts of coal, water and optionally additives for producing energy used in generating electricity, heating, support processing, and manufacturing.

Typically, the coal water slurry 11, 21, 31, 41 may comprise from about 55 wt % to about 70 wt % of coal particles, from about 30 wt % to about 45 wt % of water, and optionally a certain amount, for example less than about 1 wt % of additives. It should be noted that embodiments of the invention do not limit to any particular types and amounts of coal or additives for the coal water slurry. Non-limiting examples of the additives 122, 142, 222, 280, 342, 380, 480 include alkylnaphthelene sulfonate and polyoxyalkylene alkyl ether.

In some embodiments, the coal water slurry 11, 21, 31, 41 has the following particle size distribution (PSD): first coal particles in a range of from about 20 wt % to about 50 wt % of the coal in the coal water slurry 11, 21, 31, 41 and having particle sizes smaller than 44 m, second coal particles in a range of from about 20 wt % to about 70 wt % of the coal in the coal water slurry 11, 21, 31, 41 and having particle sizes in a range of from about 44 m to about 420 m, and third coal particles in a range of from 10 wt % to about 40 wt % of the coal in the coal water slurry 11, 21, 31, 41 and having particle sizes in a range of from about 420 m to about 1000 m. As used herein, wt % means a weight percentage.

In some embodiments, the first coal particles may be in range of from about 25 wt % to about 45 wt % of the weight of the coal in the coal water slurry 11, 21, 31, 41. The second coal particles may be in a range of from about 30 wt % to about 60 wt % of the weight of the coal in the coal water slurry 11, 21, 31, 41. The third coal particles may be in a range of from about 20 wt % to about 30 wt % of the weight of the coal in the coal water slurry 11, 21, 31, 41. In certain applications, the first coal particles may be in a range of from about 30 wt % to about 40 wt % of the weight of the coal in the coal water slurry 11, 21, 31, 41. The second coal particles may have the particle sizes in a range of from about 75 μm to about 250 μm. The third coal particles may have the particle sizes in a range of from about 600 μm to about 850 μm. Additionally, the second coal particles may have the particle sizes in a range of from about 150 μm to about 250 μm.

In some embodiments, the system 10, 20, 30, 40 optionally comprises a filtering unit 19, 29, 39, 49 after the mixing unit 18, 28, 38, 48 to remove impurities such as rock from the coal water slurry 11, 21, 31, 41 before the coal water slurry 11, 21, 31, 41 is sent to a combustion unit 101, 201, 301, 401, e.g., a gasifier.

In some applications, in order to save energy for milling the coal particles, during milling, a portion of the coarse coal water slurry 13, 23, 33, 43 are introduced into the second unit 14, 24, 34, 44 for producing the at least a portion of the ultrafine coal water slurry 15, 25, 35, 45.

After mixing, the coal particles having the relatively smaller particle sizes may be dispersed between the coal particles having the relatively larger particle sizes so as to increase the coal concentration of the coal water slurry 11, 21, 31, 41 to be prepared. In addition, the stream of dry coarse coal particles 17, 27, 37, 47 may absorb the extra water in the stream of coarse coal water slurry 13, 23, 33, 43 and the stream of ultrafine coal water slurry 15, 25, 35, 45, which further improves the coal concentration of the coal water slurry 11, 21, 31, 41. On the other hand, the coal particles in the ultrafine coal water slurry 15, 25, 35, 45 are prepared by wet grinding, thereby reducing the cost for explosion proof during grinding and handling ultrafine dry coal particles and eliminating the problem of the ultrafine particles agglomeration taking place while mixing with water.

Furthermore, low rank coal may be used to produce the coal water slurry which is cost effective. In certain applications, other suitable carbonaceous materials may also be used.

EXAMPLES

The following example is included to provide additional guidance to those of ordinary skill in the art in practicing the claimed invention. This example does not limit the invention as defined in the appended claims.

Properties of one coal having a Hardgrove index (HGI) of 106 are shown in Table 1 and Table 2 below. The highest concentration of this coal in a coal water slurry (CWS) made using a traditional wet rod mill is 54.63 wt % which is achieved at viscosity of 565.33 cp and has a particle size distribution (PSD) shown in Table 3.

TABLE 1

| Ultimate Analysis (wt %, Dry Basis) | | | | | |
|---|---|---|---|---|---|
| Carbon | Hydrogen | Nitrogen | Sulfur | Ash | Oxygen |
| 74.37 | 4.15 | 0.70 | 0.82 | 4.92 | 15.04 |

TABLE 2

| Proximate Analysis (wt %, DryBasis) | | |
|---|---|---|
| Volatile | Fixed Carbon | Ash |
| 30.39 | 64.69 | 4.92 |

TABLE 3

| Particle sizes (μm) | Weight percentage (wt %) |
|---|---|
| 420-1000 | 10.9 |
| 250-420 | 19.6 |
| 150-250 | 14.0 |
| 75-150 | 13.3 |
| 44-75 | 7.9 |
| <44 | 34.3 |

In order to further improve this coal's CWS performance including both concentration and flow ability, an example of the process proposed in this invention was applied as below. Three streams of raw grinding products of the coal were prepared: stream one was the wet coarse CWS ground by a rod mill having a mean particle size (d50) of 150 μm and a PSD shown in Table 4 below; the second stream was the dry coarse pulverized coal ground by a dry ball mill with a d50 of 259 μm and a PSD shown in table 5 below; and the third stream is the ultrafine wet CWS with d50 of 13 μm and a PSD shown in Table 6 below.

TABLE 4

| PSD of wet coarse CWS from rod mill | |
|---|---|
| Particle sizes (μm) | Weight percentage (wt %) |
| 420-1000 | 19.0 |
| 250-420 | 18.7 |
| 150-250 | 12.2 |
| 75-150 | 12.3 |
| 44-75 | 7.1 |
| <44 | 30.7 |

TABLE 5

| PSD of dry coarse ball mill product | |
|---|---|
| Particle sizes (μm) | Weight percentage (wt %) |
| 420-1000 | 34.7 |
| 250-420 | 16.2 |
| 150-250 | 11.6 |
| 75-150 | 11.6 |
| 44-75 | 6.6 |
| <44 | 19.3 |

TABLE 6

| PSD of ultrafine wet CWS | |
|---|---|
| | Size (μm) |
| D90 | 22.80 |
| D50 | 12.52 |
| D10 | 5.015 |

The three streams of raw products were mixed with a percentage as shown in Table 7 below. In the mixing step, a coal water slurry additive FP (Q/GHBC202-2003) from Shanghai Coking and Chemical Co., Shanghai, China was introduced with a ratio of dried additive and dried coal being 0.7%. After mixing uniformly, the coal concentration of the final CWS was measured with a moisture analyzer (Sartorius MA 30) to be 59.9% at a viscosity of 1000 cp measured by a viscometer (Anton Paar MCR 300).

TABLE 7

| | D50/ μm | Moisture content, % | Amount added into the final CWS, g (wet basis) | Amount added into the final CWS, g (dry basis) | Percentage in final CWS, % (dry basis) | CWS concentration, wt % |
|---|---|---|---|---|---|---|
| Wet coarse CWS from rod mill | 150 | 48.60 | 46.08 | 23.69 | 54.10 | N/A |
| Dry coarse ball mill product | 259 | 15.45 | 16.20 | 13.70 | 31.29 | N/A |
| Ultrafine CWS | 13 | 54.86 | 14.18 | 6.40 | 14.61 | N/A |
| Final CWS | 124 | 42.74 | N/A | N/A | 100 | >59.9% (@ 1000 cp) |

Therefore, the coal concentration of the coal water slurry reached about 59.9% while the viscosity was about 1000 cp and was increased over 5% with acceptable flowability compared with the conventional method.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the spirit and scope of the disclosure as defined by the following claims.

What is claimed is:

1. A system for preparing a coal water slurry, comprising:
a first unit for providing a stream of coarse coal water slurry;
a second unit for providing a stream of ultrafine coal water slurry;
a third unit for providing a stream of dry coarse coal particles; and
a mixing unit for mixing the stream of coarse coal water slurry, the stream of ultrafine coal water slurry and the stream of dry coarse coal particles.

2. The system of claim 1, wherein the first unit comprises a wet mill.

3. The system of claim 1, wherein the third unit comprises a dry mill or a dry crusher.

4. The system of claim 1, further comprising a filtering unit after the mixing unit.

5. The system of claim 1, wherein coal from the stream of coarse coal water slurry is greater than about 30 wt % coal of the coal water slurry.

6. The system of claim 1, wherein coal from the stream of ultrafine coal water slurry is less than about 30 wt % of coal of the coal water slurry.

7. A method for preparing a coal water slurry, comprising:
preparing a stream of coarse coal water slurry;
preparing a stream of ultrafine coal water slurry;
preparing a stream of dry coarse coal particles; and
mixing the stream of coarse coal water slurry, the stream of ultrafine coal water slurry and the stream of dry coarse coal particles.

8. The method of claim 7, wherein a wet mill is employed to prepare the stream of coarse coal water slurry.

9. The method of claim 7, wherein a dry mill or a dry crusher is employed to prepare the dry coarse coal particles.

10. The method of claim 7, wherein a wet mill is employed to prepare the stream of ultrafine coal water slurry.

11. The method of claim 7, wherein the coarse coal water slurry comprises an additive.

12. The method of claim 7, wherein the ultrafine coal water slurry comprises an additive.

13. The method of claim 7, further comprising:
adding an additive during mixing the stream of coarse coal water slurry, the stream of ultrafine coal water slurry and the stream of dry coarse coal particles.

14. The method of claim 7, further comprising:
filtering a mixture of the stream of coarse coal water slurry, the stream of ultrafine coal water slurry and the stream of dry coarse coal particles.

15. The method of claim 7, wherein the stream of coarse coal water slurry comprises coal particles having a maximum particle size of less than about 1500 μm and a mean particle size of greater than about 100 μm.

16. The method of claim 7, wherein the stream of ultrafine coal water slurry comprises coal particles having a mean particle size of smaller than about 20 μm.

17. The method of claim 7, wherein the stream of dry coarse coal particles comprises coal particles having a maximum particle diameter of less than 1500 μm and a mean particle size of greater than about 100 μm.

18. The method of claim 7, wherein coal from the stream of coarse coal water slurry is greater than about 30 wt % of coal of the coal water slurry.

19. The method of claim 7, wherein coal from the stream of ultrafine coal water slurry is less than about 30 wt % of coal of the coal water slurry.

20. A method for preparing a coal water slurry, comprising:
preparing a stream of coarse coal water slurry, wherein the stream of coarse coal water slurry comprises coal particles having a maximum particle size of less than about 1500 μm and a mean particle size of greater than about 100 μm;
preparing a stream of ultrafine coal water slurry, wherein the stream of ultrafine coal water slurry comprises coal particles having a mean particle size of smaller than about 20 μm;
preparing a stream of dry coarse coal particles, wherein the stream of dry coarse coal particles comprises coal particles having a maximum particle diameter of less than 1500 μm and a mean particle size of greater than about 100 μm; and
mixing the stream of coarse coal water slurry, the stream of ultrafine coal water slurry and the stream of dry coarse coal particles, to prepare a mixture,
wherein coal from the stream of coarse coal water slurry is greater than about 30 wt % of coal in the mixture, and coal from the stream of ultrafine coal water slurry is less than about 30 wt % of coal in the mixture.

* * * * *